US009119524B2

(12) United States Patent
Renz et al.

(10) Patent No.: US 9,119,524 B2
(45) Date of Patent: Sep. 1, 2015

(54) DISHWASHER RACK INSERT

(75) Inventors: Eugen Renz, Bielefeld (DE); Dirk Wegener, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 628 days.

(21) Appl. No.: 13/082,419

(22) Filed: Apr. 8, 2011

(65) Prior Publication Data

US 2011/0253650 A1 Oct. 20, 2011

(30) Foreign Application Priority Data

Apr. 15, 2010 (EP) ..... 10401055

(51) Int. Cl.
*A47L 15/50* (2006.01)

(52) U.S. Cl.
CPC ..... *A47L 15/503* (2013.01); *A47L 15/505* (2013.01)

(58) Field of Classification Search
CPC ... A47L 15/505; A47L 15/502; A47L 15/501; A47L 15/50; A47L 19/04; A47L 19/00; A47L 15/503
USPC ..... 211/41.2, 41.3, 41.4, 41.5, 41.6, 41.8, 211/41.9, 85.25, 181.1; D32/3, 55–59; 220/487, 488
See application file for complete search history.

(56) References Cited

U.S. PATENT DOCUMENTS 934,721 A * 9/1909 Garretson ..... 211/85.25
D166,510 S * 4/1952 Watral ..... D32/55
2,708,037 A * 5/1955 Planeta ..... 211/74
2,710,617 A * 6/1955 James et al. ..... 134/183
D187,430 S * 3/1960 Christoffersen ..... D32/55
3,167,183 A * 1/1965 Claywell et al. ..... 211/41.2
3,169,641 A * 2/1965 Chapman ..... 211/74
4,475,656 A * 10/1984 Collier ..... 211/41.8
4,848,217 A * 7/1989 Koziol ..... 99/426
D306,926 S * 3/1990 Heller et al. ..... D32/55
5,295,589 A * 3/1994 Riepl ..... 211/41.4
D353,923 S * 12/1994 Drake ..... D32/55
5,423,437 A * 6/1995 Kayem ..... 211/70.7
D363,578 S * 10/1995 Brightbill et al. ..... D32/55
5,649,630 A * 7/1997 Remmler ..... 211/41.8
6,109,455 A 8/2000 Schroeder
6,364,130 B2 * 4/2002 Wright ..... 211/41.3
6,571,965 B1 * 6/2003 Beck et al. ..... 211/41.8
7,228,975 B2 * 6/2007 Yang et al. ..... 211/41.4
7,231,929 B2 * 6/2007 Landsiedel et al. ..... 134/135
7,267,131 B2 * 9/2007 Woo ..... 134/135
7,407,059 B2 * 8/2008 Sullivan et al. ..... 211/41.3
7,455,184 B2 * 11/2008 Yang et al. ..... 211/41.4

(Continued)

FOREIGN PATENT DOCUMENTS

AL 0898929 A1 3/1999
AL 10322423 A1 12/2004

(Continued)

*Primary Examiner* — Stanton L Krycinski
(74) *Attorney, Agent, or Firm* — Leydig, Voit & Mayer, Ltd.

(57) ABSTRACT

A rack insert for a dishwasher rack includes a plurality of undulated wire members disposed successively along a loading direction of a dishwasher. Each undulating wire member includes first and second ends and extends across a majority of a width direction of the dishwasher rack. Each undulating wire member includes a plurality of curves and a tine integrally formed at each of the first and second ends. Each tine extends upward in a vertical direction of the dishwasher.

10 Claims, 5 Drawing Sheets

(56) References Cited

U.S. PATENT DOCUMENTS

| | | | | |
|---|---|---|---|---|
| 7,644,826 | B2 * | 1/2010 | Koch et al. | 211/41.4 |
| 7,690,517 | B2 * | 4/2010 | Purushothaman et al. | 211/41.8 |
| 7,766,175 | B2 * | 8/2010 | Jadhav et al. | 211/41.9 |
| 8,042,559 | B2 * | 10/2011 | Choi et al. | 134/137 |
| 2005/0241686 | A1 * | 11/2005 | Woo | 134/135 |
| 2006/0243681 | A1 * | 11/2006 | Bastuji et al. | 211/41.8 |
| 2006/0254992 | A1 * | 11/2006 | Lim | 211/41.9 |
| 2007/0039904 | A1 * | 2/2007 | Purushothaman | 211/41.8 |
| 2007/0039905 | A1 * | 2/2007 | Purushothaman | 211/41.8 |
| 2007/0131696 | A1 * | 6/2007 | Schessl et al. | 220/489 |
| 2008/0029465 | A1 * | 2/2008 | Yang et al. | 211/41.5 |
| 2008/0110480 | A1 * | 5/2008 | Choi et al. | 134/135 |
| 2009/0120883 | A1 * | 5/2009 | Jadhav et al. | 211/41.9 |
| 2010/0012601 | A1 * | 1/2010 | Meshkinfam | 211/41.3 |
| 2010/0314977 | A1 * | 12/2010 | Mallory et al. | 312/228.1 |

FOREIGN PATENT DOCUMENTS

| | | | |
|---|---|---|---|
| AL | WO 2009041899 | A1 | 4/2009 |
| EP | 2335548 | A1 | 6/2011 |

* cited by examiner

DISHWASHER RACK INSERT

CROSS REFERENCE TO RELATED APPLICATIONS

This application claims priority to European Patent Application No. EP 10 401 055.8, filed Apr. 15, 2010, which is hereby incorporated by reference herein in its entirety.

FIELD

The present invention relates to a rack insert for a dishwasher rack.

BACKGROUND

WO 2009/041899 A1 describes a dishwasher rack including undulating wire members.

Conventional dishwashers generally have at least two dish racks, namely one referred to as "lower rack" and one referred to as "upper rack". When used as intended in a dishwasher, these racks are used to accommodate items to be washed. In order to facilitate loading and unloading of such a dish rack, the dish racks are adapted to be moved by a user into and out of the dishwashing space provided by the dishwasher.

In order to optimize the utilization of the dishwashing space provided by the dishwasher, and also to prevent the items to be washed that are accommodated in a dishwasher rack from being damaged during movement of the rack, various rack inserts serve to accommodate items to be washed in a positionally stable and orderly manner.

Rack inserts typically provide either what may be referred to as "undulated wire members" or what may be referred to as "tines". Generally, the undulated wire members are arranged in succession one behind the other, the space between two undulated wire members being used, in particular, to accommodate an item to be washed in the form of a plate. Similarly, the tines are arranged in rows, each row generally including two tines. The receiving space formed between two rows of tines is also used, in particular, to receive plate-shaped items to be washed.

In conventional dishwasher rack inserts having undulated wire members, the undulated wire members are formed in the regions of the lateral railings such that they extend upwardly in a vertical direction of the dishwasher. In order to prevent the plates held by the undulated wire members from projecting beyond the lateral boundaries of the dish rack during the intended use thereof, the portions of the undulated wire members that extend in a vertical direction of the dishwasher are spaced apart from the respective lateral rack boundaries. Disadvantageously, this results in a dead space that cannot be used to accommodate items to be washed other than plates.

In contrast to undulated wire members, tines can be used by the user in a much more flexible manner. Thus, for example, the tines may also be used to securely hold hollow vessels, such as pots, bowls, glasses and/or the like, which are placed with their openings over the tines. On the other hand, undulated wire members prove particularly advantageous for holding plates, because they are able to secure plates in position and to protect them from shaking more efficiently than tines.

As can be seen in FIGS. 8 and 9, a prior dishwasher rack insert (a) can be used for accommodating items to be washed, said dishwasher rack insert being supported by a dishwasher rack (b) during its intended use. Dishwasher rack insert (a) includes undulated wire members (c) arranged one behind the other in the loading direction, each undulated wire member (c) being provided with a curved section (d). In the following, a curved section (d) will be understood to be a partial length of an undulated wire member (c) which is substantially U-shaped and thus defines a section which is open at the top and closed at the bottom. A curved section (d) may have one, but also several curves. In the partial views of FIGS. 8 and 9, a curved section (d) is shown on the left side as viewed in the loading direction (f). Two curved sections (d) belonging to undulated wire members located one behind the other in loading direction (f) form a receiving space (e) therebetween, which serves for accommodating items to be washed, in particular plates.

Each undulated wire member (c) merges into a leg (g) at its left end, as viewed in loading direction (f), said leg extending in a vertical direction parallel to the respective side wall (h) of dishwasher rack (b). This configuration is required in order to provide additional lateral support for large plates (not shown) at the plate-receiving space (e) provided by curved sections (d). As may be seen particularly in the view of FIG. 9, it is also known in the art that the vertically upwardly extending leg (g) merges into an extension (k) which may be angled and in turn provides a further receiving space (e) for items to be washed, said further receiving space being in the form of a hinged cup rack (i). The aforedescribed configuration of dishwasher rack (b) and rack insert (a) results in a dead space (l) which extends in loading direction (f) between legs (g) of rack insert (a) and side wall (h) of dishwasher rack (b) on each of the left and right sides as viewed in loading direction (f). This dead space (l) is an area that cannot be used to accommodate non-plate-shaped items to be washed.

Although there are various dishwasher rack inserts that have proven practical in everyday use, there is still a need for improvement, particularly to further optimize space utilization.

SUMMARY

In an embodiment, the present invention provides a rack insert for a dishwasher rack including a plurality of undulated wire members disposed successively along a loading direction of a dishwasher. Each undulating wire member includes a first and a second end and extends across a majority of a width direction of the dishwasher rack. Each undulating wire member includes a plurality of curves and a tine integrally formed at each of the first and second ends. Each tine extends upward in a vertical direction of the dishwasher.

BRIEF DESCRIPTION OF THE DRAWINGS

Other aspects and advantages of the present invention will be apparent from the following description taken in conjunction with the accompanying drawings, in which.

DETAILED DESCRIPTION

Figure 1:
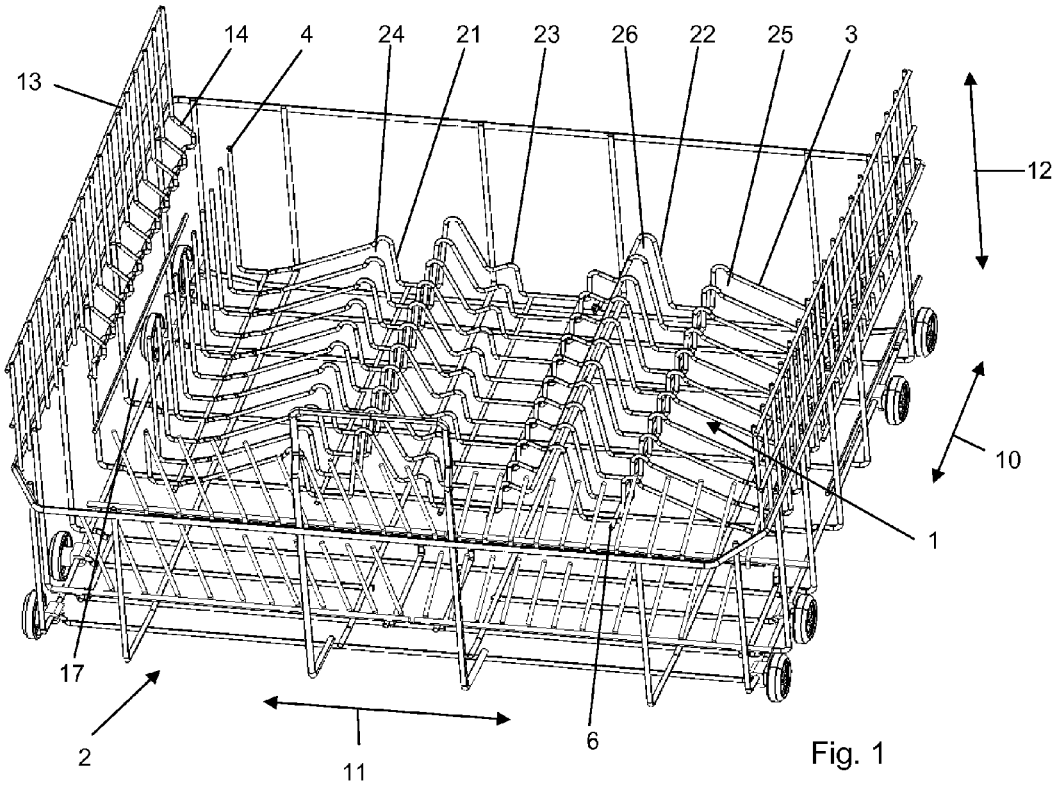
FIG. 1 is schematic perspective view of a dishwasher rack having an insert according to an embodiment of the present invention.

In an embodiment, the present invention provides a rack insert for a dishwasher rack that improves the utilization of the dishwashing space provided by the dishwasher.

An embodiment of the present invention provides a rack insert for a dishwasher rack, in particular for a lower rack of a dishwasher. The rack insert includes a plurality of undulated wire members which are arranged one behind the other in the loading direction of the dishwasher and each extend in the width direction of the dishwasher rack over nearly the entire width thereof, each undulated wire member being multiply curved and integrally merging at its ends into a respective tine extending upwardly in a vertical direction of the dishwasher.

The dishwasher rack insert is a combination of undulated wire members and tines advantageously arranged in such a way that the dishwashing space provided by the dishwasher is enhanced, allowing it to be used in a more optimized manner.

The improved space utilization is made possible in particular by the fact that, despite the use of undulated wire members, the left and right railing regions of the dish rack can be used in a more optimized and more flexible manner.

Embodiments of the present invention improve the use of space by avoiding the dead space described above associated with conventional undulated wire members. As a result, an advantageous design is obtained which, thanks to the undulated wire members provided, not only is capable of securely holding in particular plate-shaped items to be washed, but also allows for flexible use by making it possible to accommodate also hollow vessels, such as, for example, glasses, vases and/or the like. Furthermore, embodiments of the present invention eliminate the need for dead space, which allows the dishwashing space to be used in an overall more optimized manner.

In an embodiment, the dishwasher rack insert of the present invention has a plurality of undulated wire members arranged one behind the other in the loading direction of the dishwasher. Each undulated wire member is multiply curved and serves as a support for items to be washed, in particular for plates. At each of its left and right ends, as the viewed in the loading direction of the dishwasher, the undulated wire member integrally merges into a tine extending upwardly in a vertical direction of the dishwasher. Thus, a configuration is obtained which is preferably made of a single continuous wire and which at its left end, as viewed in the loading direction of the dishwasher, has a tine extending upwardly in a vertical direction of the dishwasher, said tine integrally merging into an undulated wire member which in turn merges into a second tine at its other end; i.e., at its right end. A plurality of such wire configurations are arranged one behind the other in the loading direction of the dishwasher, so that spaces are formed between each two wire configurations for accommodating items to be washed. The dishwasher rack insert provides the advantage that the undulated wire members can be used also in combination with the tines provided at the ends in order to support plates, and that, in addition, the tines provided at the ends of the undulated wire members may also be used for securely holding other items to be washed.

In accordance with a further aspect of the present invention, the support for items to be washed can be provided by two spaced-apart curved sections, the curved sections belonging to two undulated wire members and located one behind the other in the loading direction, in each case form a space therebetween for accommodating items to be washed. The space formed between two curved sections of two undulated wire members for accommodating items to be washed is normally used for receiving a plate-shaped item to washed. Since two curved sections are provided per undulated wire member in the width direction of the dishwasher rack insert, two items to be washed, in particular plates, may be accommodated in two rows arranged side by side, as viewed in the loading direction of the dishwasher.

In accordance with another aspect of the present invention, at least one further curved section can be formed between the two spaced-apart curved sections of an undulated wire member. In this manner, a third row for receiving in particular plate-shaped items to be washed is formed in the loading direction. The configuration of the curved sections is preferably selected such that the further curved sections; i.e., the central curved sections as viewed the width direction of the dishwasher rack insert, serve to accommodate in particular large items to be washed; i.e., in particular plates having a large diameter.

The aforedescribed arrangement of curved sections including two first curved sections and one further curved section disposed therebetween advantageously allows the dishwasher rack insert to be loaded in a flexible manner. Thus, the two widthwise outer arrangements of curved sections may be used, for example, to accommodate large plates. Alternatively, it is possible to use only the central arrangement of curved sections for accommodating even larger plates. Depending on the diameter of the plates, it may also be possible to use three plate rows, provided the plates are sufficiently small. Finally, it is also possible to arrange plates such that they are alternately staggered in each undulated wire member in the loading direction of the dishwasher. Thus, the two outer arrangements of curved sections, as viewed in the width direction of the dishwasher, may be used to place items to be washed in every second receiving space in the loading direction, while using the widthwise central arrangement of curved sections to accommodate plates in staggered relationship thereto, so that the plates are arranged with gaps therebetween.

In an embodiment, the present invention provides a dishwasher rack equipped with a rack insert including the above-described features. Preferably, the rack insert is removably arranged on the dishwasher rack, which allows a user to remove the rack insert as needed, for example, to be able to place large-volume pots, bowls or the like in the dish rack.

In accordance with a further aspect of the present invention, the dishwasher rack can include a lateral railing. This lateral railing may be provided with a wire profile configured to correspond to the rack insert. The wire profile serves to laterally support an item to be washed that is accommodated in the rack insert.

The wire profile of the lateral railing can have undulated wire members which may be referred to as "noses", which each lie in the same plane as the associated undulated wire member of the rack insert inserted in the dishwasher rack. Accordingly, the noses each provide a support which lies in the same plane as the associated undulated wire member of the dishwasher rack insert.

In accordance with another aspect of the present invention, the railing of the dishwasher rack may have hinged thereto a support for items to be washed, such as one that can be used to support small vessels, such as cups and/or the like.

Figure 8:
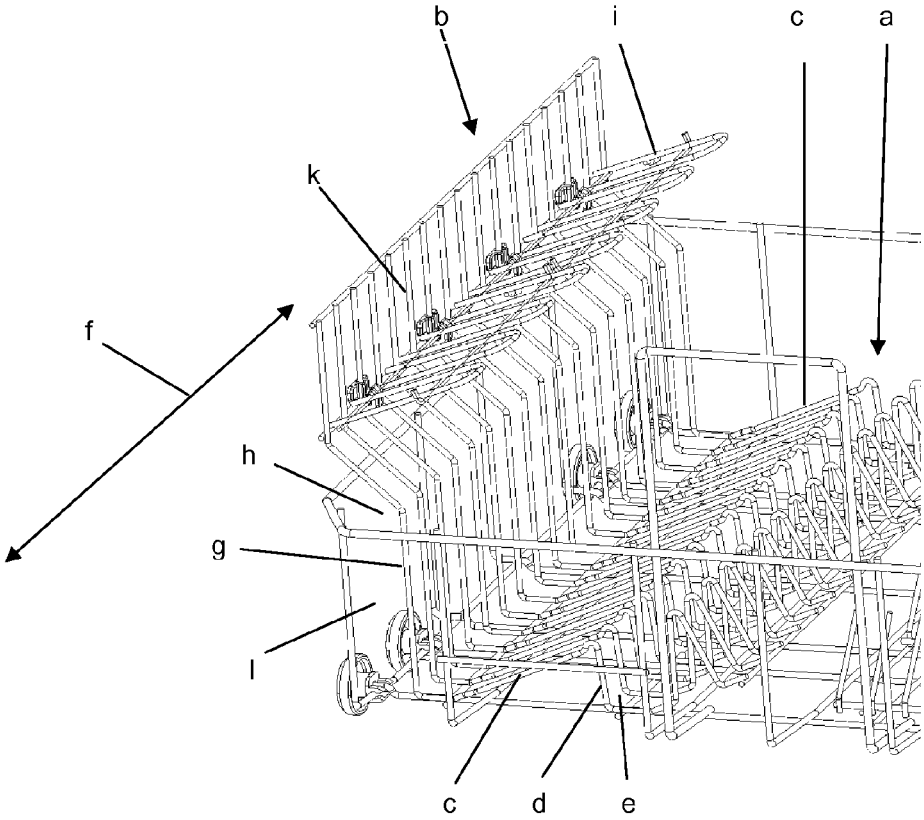
Fig. 8 PRIOR ART
FIG. 8 is a schematic perspective view of a portion of a conventional dishwasher rack.
Figure 9:
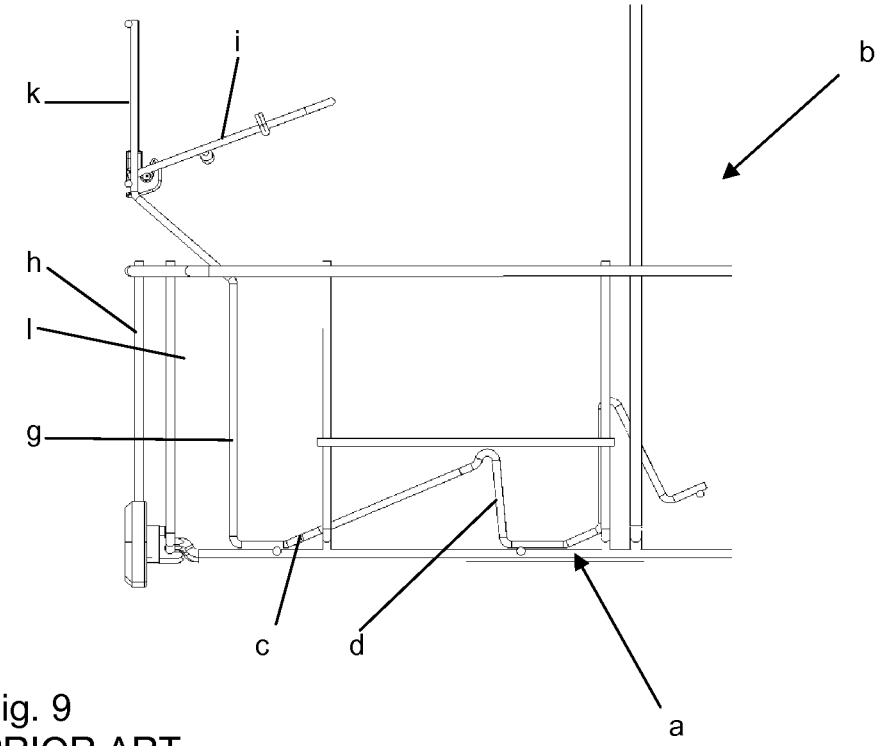
Fig. 9 PRIOR ART
FIG. 9 is a schematic perspective front view of a portion of the dishwasher rack according to FIG. 8.

Embodiments of the present invention are shown in FIGS. 1 through 7 which, when considered in conjunction with one another, illustrate that the dead space (l) encountered in the racks shown in FIGS. 8 and 9 has advantageously been eliminated.

A dishwasher rack 2 having a rack insert 1 according to an embodiment of the present invention is shown in the schematic perspective view of FIG. 1. The figure shows a dishwasher rack 2 with the insert secured in position thereto.

Figure 2:
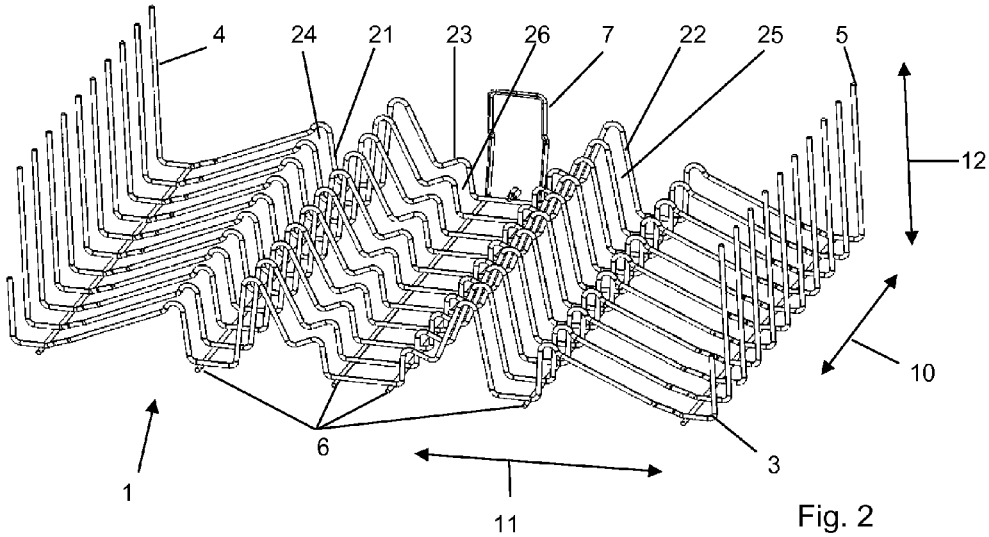
FIG. 2 is an isolated view of a removable insert.

FIG. 2 is an isolated view showing a removable dishwasher rack insert 1 removed from rack 2. Dishwasher rack insert 1 has a plurality of undulated wire members 3 arranged one behind the other in loading direction 10. Undulated wire members 3 extend in width direction 11, each undulated wire member 3 being multiply curved. At each of their right and left ends, undulated wire members 3 integrally merge into a tine 4, respectively 5, extending upwardly in a vertical direction 12. In order to make an undulated wire member 3 and the tines 4 and 5 integrally formed at the ends thereof, it is preferred to use a continuous wire which is sheathed with plastic in a generally known manner. As may be seen particularly in the view of FIG. 2, connecting rods 6 are used to space undulated wire members 3 at defined distances apart in loading direction 10. In the central region of undulated wire members 3 as viewed in width direction 11, there are provided two connecting rods 6 which together form a connecting arrangement having a handle 7. Handle 7 allows the user to grasp dishwasher rack insert 1, making it easier to insert rack insert 1 into dishwasher rack 2 and to remove it therefrom.

As FIG. 2 further shows, each undulated wire member 3 has two outer curved sections 21 and 22, which are spaced apart in width direction 11. Due to this design, curved sections 21 and 22 belonging to two undulated wire members 3 and located one behind the other in loading direction 10 form receiving spaces 24, respectively 25, therebetween for accommodating items to be washed. These receiving spaces 24 and 25 serve in particular for accommodating plate-shaped items to be washed.

A further curved section 23 is formed between the spaced-apart curved sections 21 and 22, the individual curved sections 21, 22 and 23 partially merging into each other. Further curved sections 23 belonging to two undulated wire members 3 and located one behind the other in loading direction 10 form a respective further receiving space 26 therebetween, which also serves in particular for accommodating plate-shaped items to be washed. Thus, depending on the size of the plates, plates may be accommodated in three rows in width direction 11, possibly in a staggered arrangement.

Figure 3:
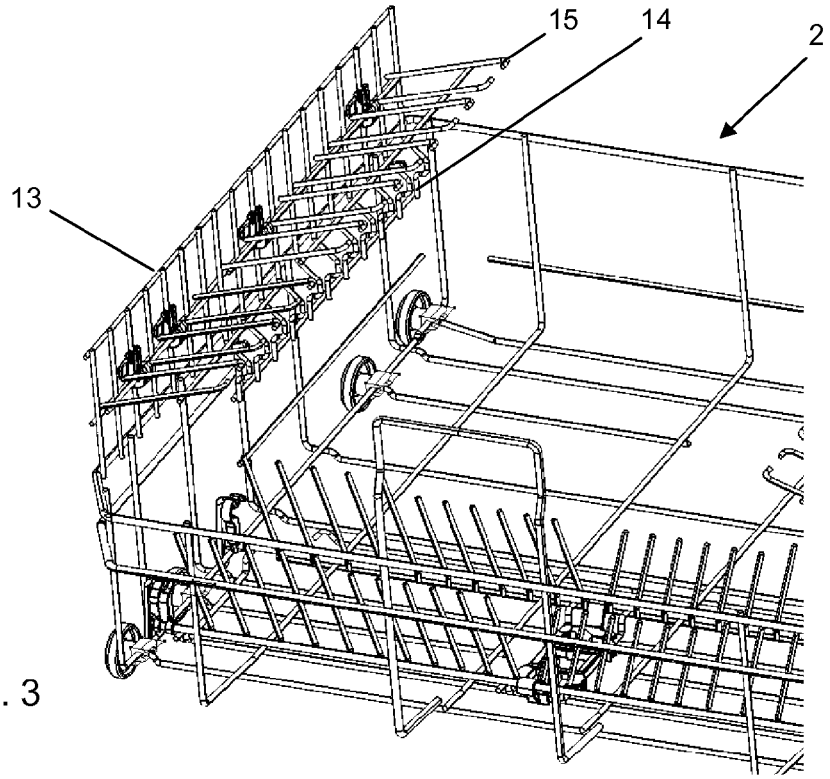
FIG. 3 is a view showing a dishwasher rack according to FIG. 1 without the insert.

In FIG. 3, there can be seen the dishwasher rack 2 in accordance with an embodiment of the present invention. This dishwasher rack has a railing 13 on both the left and right sides thereof, as viewed in loading direction 10. This railing 13 is provided with undulated wire members in the form of noses 14, as can be seen particularly in the detail view of FIG. 7. Moreover, railing 13 may be provided with a cup rack 15 which is preferably hinged.

Figure 4:
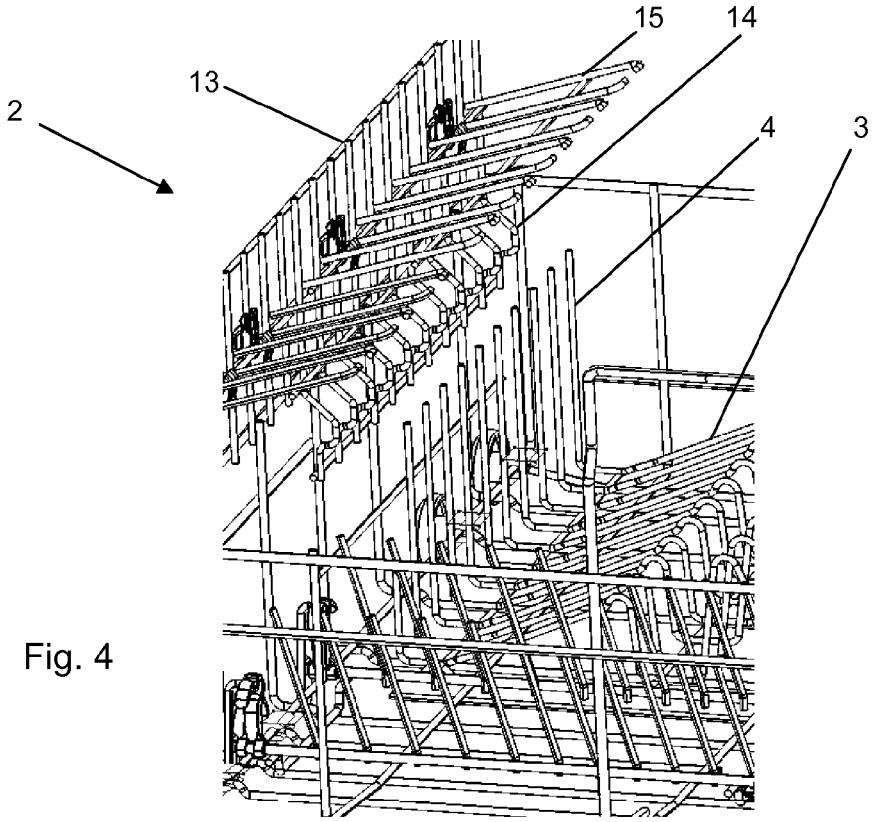
FIG. 4 is a schematic perspective view of a portion of the dishwasher rack according to FIG. 3, shown with the rack insert of FIG. 2 inserted.
Figure 5:
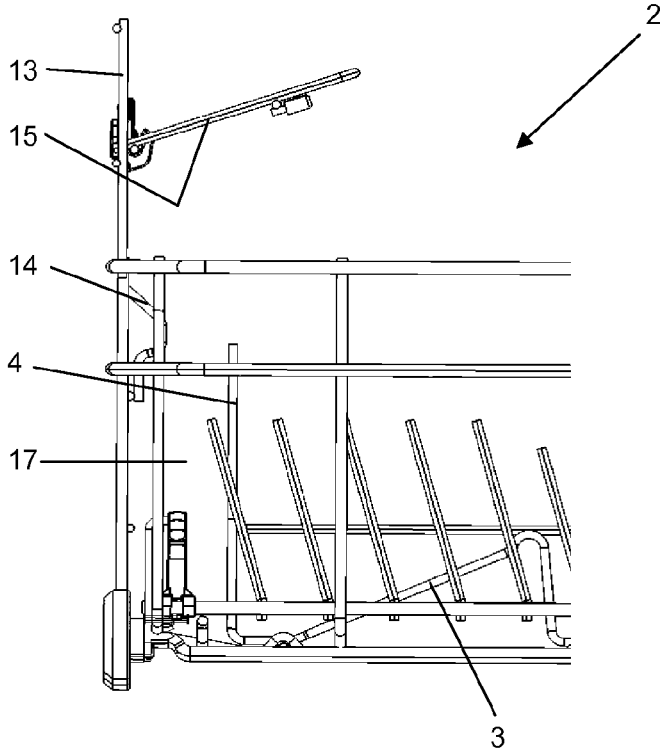
FIG. 5 is a schematic perspective front view of a portion of the dishwasher rack shown in FIG. 4.
Figure 6:
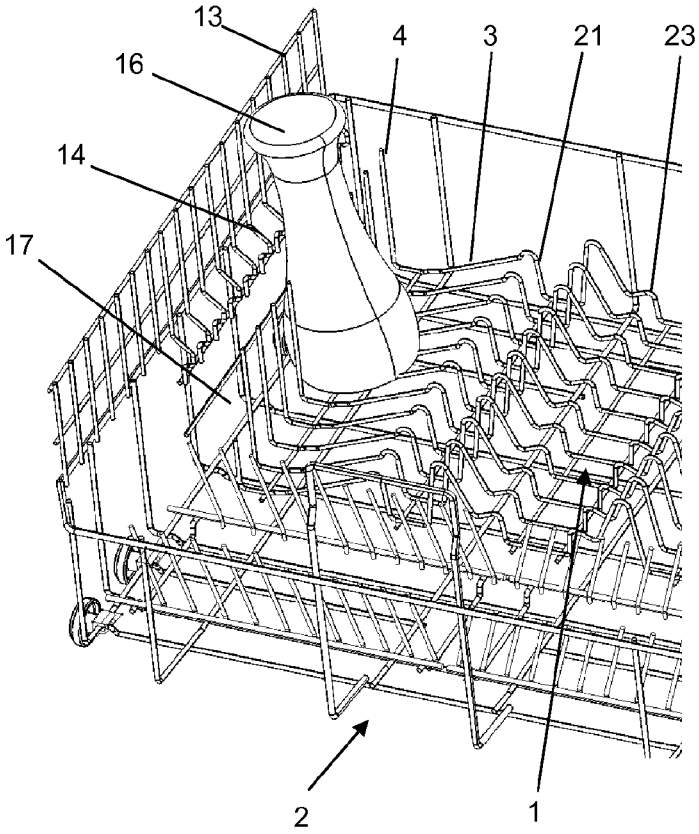
FIG. 6 is a schematic perspective view of a portion of the dishwasher rack shown in FIG. 4, without the hinged support for items to be washed.
Figure 7:
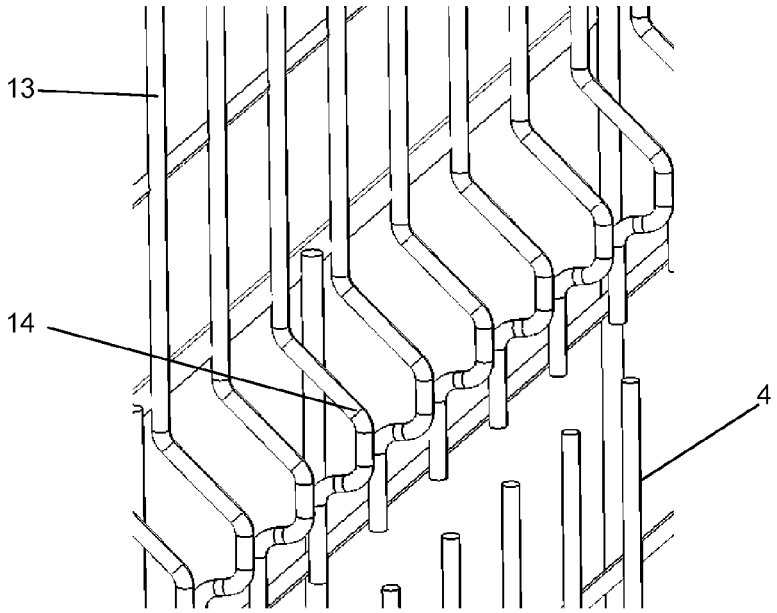
FIG. 7 is a schematic perspective detail view of a portion of the lateral railing of the dishwasher rack according to an embodiment of the present invention.

The combined use of dishwasher rack insert 1 and dish rack 2 can be seen in FIGS. 4, 5 and 6. As shown in these views, curved sections 21 and 22 provided on the left and right sides, as viewed in loading direction 10, may be used in the conventional manner to accommodate in particular plates. The plates are laterally supported by noses 14 provided by railing 13, which each lie in the same plane as the associated curved sections 21 and 22, as can be seen particularly in FIG. 6.

As is visible particularly in the view of FIG. 6, the rack insert makes it possible to securely hold items 16 to be washed which are in the form of hollow vessels, this being achieved using the space 17 on the other side of tines 4 and 5, which cannot be used in prior art approaches. Thus, the design of the rack insert is advantageous over other designs in two respects. First, it allows for a more optimized space utilization by avoiding unnecessary dead space (l). Second, it allows for flexible use, because dishwasher rack insert 1 no longer serves only to accommodate plates, but may also be used to accommodate towering hollow vessels, such as wheat beer glasses, vases and/or the like.

Preferably, tines 4 and 5 of dishwasher rack insert 1 are spaced apart from the associated railing of dishwasher rack 2, so that a longitudinal space 17 is formed in loading direction 10 between railing 13 of dishwasher rack 2 and the associated tines 4, respectively 5, of rack insert 1, as can be seen particularly in the view of FIG. 5. This longitudinal space 17 may be used for accommodating in particular platter-shaped items to be washed, such as meat or cheese platters. This longitudinal space 17 is formed using the dead space (l), which cannot be used in other racks.

While the invention has been particularly shown and described with reference to preferred embodiments thereof, it will be understood by those skilled in the art that various changes in form and details may be made therein without departing from the spirit and scope of the invention.

What is claimed is:

1. A dishwasher rack comprising:

a dish rack having a depth extending in a loading direction and a width; and a rack insert including:

a plurality of undulated wire members disposed successively along the loading direction of the dish rack, each undulating wire member including a plurality of curves and having a first end and a second end and extending substantially across the entire width of the dish rack, and a tine integrally formed at each of the first and second ends of each undulating wire member, each tine extending upward from a bend at the respective end in a vertical direction;

wherein the dish rack includes a lateral railing including a wire profile configured to correspond to the rack insert;

wherein each of the tines at the first end of the undulated wire members is spaced apart from the lateral railing at a respective end of the dish rack so as to form a longitudinal space between the tines and the lateral railing, the longitudinal space being configured to accommodate items for washing.

2. The dishwasher rack recited in claim 1, wherein the dishwasher rack is configured as a lower rack of a dishwasher.

3. The dishwasher rack recited in claim 1, wherein first and second adjacent undulated wire members of the plurality of undulated wire members each includes a curved section, wherein the curved sections of the first and second adjacent undulated wire members form a receiving space therebetween configured to accommodate an item for washing.

4. The dishwasher rack recited in claim 1, wherein each undulated wire member includes two spaced-apart curved sections, and wherein pairs of curved sections corresponding to adjacent undulated wire members form a receiving space configured to accommodate an item for washing.

5. The rack insert recited in claim 4, wherein each undulated wire member includes a thither curved section disposed between the two spaced-apart curved sections.

6. The rack insert recited in claim 5, wherein pairs of further curved sections corresponding to adjacent undulated wire members form a further receiving space configured to accommodate another item for washing.

7. The dishwasher rack recited in claim 1, wherein the rack insert is removable from the dish rack.

8. The dishwasher rack recited in claim 1, wherein the wire profile includes a plurality of noses, each nose corresponding to a respective undulated wire member of the rack insert and being disposed in a same plane as the associated undulated wire member.

9. The dishwasher rack recited in claim 1, wherein the lateral railing includes a hinged support configured to accommodate items for washing.

10. The dishwasher rack recited in claim 1, wherein each tine extends in alignment with the vertical direction.

* * * * *